United States Patent [19]

Bajek et al.

[11] 3,974,064

[45] Aug. 10, 1976

[54] CONTROL OF HYDROGEN/HYDROCARBON MOLE RATIO AND THE CONTROL SYSTEM THEREFOR

[75] Inventors: Walter A. Bajek, Lombard; James H. McLaughlin, La Grange, both of Ill.

[73] Assignee: Universal Oil Products Company, Des Plaines, Ill.

[22] Filed: Oct. 2, 1974

[21] Appl. No.: 511,403

[52] U.S. Cl. ..... 208/134; 23/253 A; 208/DIG. 1

[51] Int. Cl.[2] ..... C10G 35/04

[58] Field of Search ..... 208/DIG. 1, 138, 64, 208/139; 23/253 A; 235/151.12, 151.13

[56] References Cited

UNITED STATES PATENTS

| | | | |
|---|---|---|---|
| 3,000,812 | 9/1961 | Boyd | 208/138 |
| 3,649,202 | 3/1972 | Bajek et al. | 208/139 |
| 3,733,476 | 5/1973 | Hopkins et al. | 208/134 |

*Primary Examiner*—Herbert Levine
*Attorney, Agent, or Firm*—James R. Hoatson, Jr.; Robert W. Erickson; William H. Page, II

[57] ABSTRACT

A system for controlling the hydrogen/hydrocarbon mole ratio in a continuous hydrocarbon conversion process wherein the hydrocarbonaceous feed stock is catalytically reacted in a hydrogen atmosphere. Applicable to both hydrogen-consuming and hydrogen-producing processes, in which the reaction zone effluent is separated to provide a liquid product phase and a hydrogen-rich vaporous phase, a portion of the latter being recycled to the catalytic reaction zone, the control system affords improved overall operation of the particular process in addition to increased catalyst activity and stability. Analyzers are utilized to monitor composition characteristics of the charge stock and liquid product, and the hydrogen concentration of the vaporous phase recycled to the reaction zone. Representative output signals are transmitted to comparator/computer means which compares the rate of change and actual values of the composition characteristics and the hydrogen concentration, and generates additional output signals which are utilized within the control system for regulating the hydrogen/hydrocarbon mole ratio of the combined charge to the reaction zone.

16 Claims, 2 Drawing Figures

CONTROL OF HYDROGEN/HYDROCARBON MOLE RATIO AND THE CONTROL SYSTEM THEREFOR

APPLICABILITY OF INVENTION

The method for regulating the hydrogen/hydrocarbon mole ratio and the control system encompassed by the inventive concept herein described, are generally applicable to processes for the catalytic conversion of hydrocarbons in a hydrogen-containing atmosphere. Such processes include the catalytic reforming of naphtha fractions to produce a relatively high octane liquid product, hydrocracking to produce lower molecular weight hydrocarbons, paraffinic dehydrogenation to produce olefinic hydrocarbons, hydrocarbon isomerization and hydrorefining for the purpose of contaminant removal, etc. Notwithstanding that these processes involve hydrogen-consuming reactions, hydrogen-producing reactions, or both, a commonly practiced technique involves the utilization of a hydrogen-rich vaporous phase which is recycled to combine with the fresh hydrocarbon charge to the reaction zone.

In processes for the catalytic conversion of a hydrocarbonaceous charge stock, the technique of recycling a hydrogen-rich vaporous phase, which is separated from the reaction zone effluent, is a common practice. Practical reasons for utilizing this technique reside in maintaining both the activity and operational stability of the catalytic composite employed to effect the desired reactions, and the assurance of achieving the desired quantity and/or quality product slate. In hydrogen-producing processes, such as catalytic reforming, hydrogen in excess of that required for recycle purposes is recovered and utilized in other processes integrated into the overall refinery. For example, excess hydrogen from a catalytic reforming unit is often employed as make-up hydrogen in a hydrocracking process wherein the reactions being effected are principally hydrogen-consuming. Regardless of the particular process, the recycled hydrogen is generally obtained by condensing the reaction zone product effluent, most often at a temperature in the range of about 60°F. to about 140°F, and introducing the thus-cooled effluent into a vapor-liquid separation zone. That portion of the recovered vaporous phase necessary to satisfy the hydrogen requirement within the reaction zone is recycled to combine with the hydrocarbon charge stock prior to the introduction thereof into the reaction zone.

Prior art abounds with hydrocarbon conversion processes wherein a relatively hot reaction zone effluent is condensed and cooled, and introduced into a high pressure separator from which a hydrogen-rich vaporous phase and a normally liquid product phase are recovered. Generally, at least a portion of the vaporous phase is recycled without further treatment, to combine with the charge stock prior to the introduction thereof into the catalytic reaction zone. In some situations, however, usually involving sulfur service, that portion of the vaporous phase to be recycled is treated to remove hydrogen sulfide.

Exemplary of the variety of processes employing this basic technique, and to which the present invention is directed, is the phase isomerization process disclosed in U.S. Pat. No. 3,131,325 (Cl. 260-683.68). Similarly, U.S. Pat. No. 3,133,012 (Cl. 208-95) illustrates this technique as applied to a catalytic reforming system. In U.S. Pat. No. 3,718,575 (Cl. 208-59), which is directed toward a two-stage hydrocracking process, the effluent from the second stage is cooled prior to the introduction thereof into a vapor-liquid separation zone; the hydrogen stream therefrom is recycled to the first stage to combine with the charge stock. The present method for regulating the hydrogen/hydrocarbon mole ratio in the combined charge to a catalytic reaction zone, and the control system therefor, are applicable to any hydrocarbon coversion process wherein a hydrocarbon charge stock and hydrogen are contacted in a catalytic reaction zone. Therefore, one invention may be readily integrated, with minor modifications, into processes such as hydrogenation, isomerization, hydrorefining, hydrocracking, hydrodealkylation, dehydrogenation, and particularly catalytic reforming, etc.

Exemplary of hydrocracking processes, into which the present invention can be integrated, are those schemes and techniques found in U.S. Pat. Nos. 3,252,018 (Cl. 208-59), 3,502,572 (Cl. 208-111) and 3,472,758 (Cl. 208-59). Hydrocracking reactions are generally effected at elevated pressures of about 500 to about 5,000 psig. Circulating hydrogen is admixed with the charge stock in an amount of about 3,000 to about 50,000 scf/Bbl., inclusive of makeup hydrogen from an external source. The charge stock contacts the catalytic composite, disposed within the hydrocracking reaction zone, at a liquid hourly space velocity of about 0.25 to about 5.0. Since the bulk of the reactions being effected are exothermic in nature, an increasing temperature gradient is experienced as the charge stock transverses the catalyst bed. The maximum catalyst bed temperatures are generally maintained in the range of about 700°F. to about 900°F., and may be controlled through the use of conventional quench streams introduced at intermediate loci.

Illustrations of catalytic reforming process schemes are found in U.S. Pat. Nos. 2,905,620 (Cl. 208-65), 3,000,812 (Cl. 208-138) and 3,296,118 (Cl. 208-100). Effective reforming operating conditions include temperatures in the range of about 800°F. to about 1100°F., and preferably from about 850°F. to about 1050°F. The liquid hourly space velocity is preferably in the range of about 1.0 to about 5.0, although space velocities from about 0.5 to about 15.0 may be employed. The quantity of hydrogen-rich recycle gas, in admixture with the hydrocarbon feed stock, is generally from about 1.0 to about 20.0 moles of hydrogen per mole of hydrocarbon. Pressures in the range of about 100 to about 1500 psig. are suitable.

Catalytic isomerization processes are shown in U.S. Pat. Nos. 2,900,425 (Cl. 260-666) and 2,924,628 (Cl. 260-666). Isomerization reactions are preferably effected in a hydrogen atmosphere utilizing sufficient hydrogen so that the hydrogen to hydrocarbon mole ratio in the reaction zone feed will be within the range of about 0.25 to about 10.0. Operating conditions will further include temperatures ranging from about 100°C. to about 300°C. (212°F. to 572°F.), although temperatures within the more limited range of about 150°C. to about 275°C. (302°F. to 527°F.) will generally be utilized. The pressure under which the reaction zone is maintained will range from 50 to about 1500 psig. Liquid hourly space velocities are maintained within the range of about 0.25 to about 10.0, and preferably in the range of 0.25 to about 5.0.

The foregoing, briefly described processes are illustrative of those into which the present invention may be advantageously incorporated. In all such processes, the hydrogen/hydrocarbon mole ratio in the combined feed to the reaction zone constitutes an important operating variable. Changes in feed stock composition characteristics require changes in the hydrogen/hydrocarbon mole ratio in order to maintain acceptable catalyst activity and stability. Furthermore, changes in reaction zone severity (principally temperature and pressure) are required as the product quality and/or quantity changes; however, this also affects the hydrogen/-hydrocarbon mole ratio. Also, changes in the hydrogen/hydrocarbon mole ratio will affect the product quality and/or quantity. Briefly, in accordance with the present control method, a charge stock composition characteristic is sensed (a product composition characteristic may also be sensed) and the hydrogen concentration within the vaporous phase introduced into the reaction zone with the feed stock is sensed. Appropriate output signals are transmitted to a comparator/-computer which in turn generates computer output signals which are transmitted as required to adjust reaction zone severity (temperature and pressure) charge stock flow and recycle gas flow in order to regulate the hydrogen/hydrocarbon mole ratio while simultaneously achieving the desired product quality and/or quantity.

OBJECTS AND EMBOIDMENTS

A principal object of our invention is to control the hydrogen/hydrocarbon mole ratio in a catalytic hydrocarbon conversion process. A corollary objective is to maintain catalyst activity ad stability while attaining the desired product slate.

Another object is to provide a control system for controlling the hydrogen/hydrocarbon mole ratio. In conjunction, it is a specific object to offer a method which compensates rapidly for changes in charge stock characteristics and operating parameters, which changes necessitate adjustment of the hydrogen/hydrocarbon mole ratio.

Therefore, in one embodiment, our invention involves a control system for utilization in a continuous hydrocarbon conversion process wherein (1) a hydrocarbonaceous charge stock is introduced into preheating means having heatsupplying means associated therewith, (2) the resulting heated charge stock and hydrogen are contacted in a catalytic reaction zone, (3) a hydrogen-containing, hydrocarbon effluent stream is withdrawn from said reaction zone, (4) said effluent stream is condensed and separated to provide a vaporous phase and a liquid phase, (5) at least a first portion of said vaporous phase is recycled at increased pressure, via compressive means, to said reaction zone, and (6) a second portion of said vaporous phase is withdrawn from said conversion process via pressure control, which control system, for regulating the hydrogen/hydrocarbon mole ratio of the combined hydrogen-charge stock feed to said reaction zone, comprises, in cooperative combination: (a) first flow-varying means for adjusting the quantity of heat supplied to said preheating means; (b) second flow-varying means for adjusting the quantity of the second portion of said vaporous phase withdrawn from said conversion process; (c) third flow-varying means for adjusting the flow of compressed vaporous phase recycled from the discharge of said compressive means; (d) a first hydrocarbon analyzer receiving a sample of said hydrcarbonaceous charge stock and developing a first output signal representative of a composition characteristic thereof; (e) a second analyzer receiving a sample of that portion of said vaporous phase recycled to said reaction zone and developing a second output signal representative of the hydrogen concentration thereof; (f) means for sensing the pressure of the separated vaporous phase and developing a third output signal representative thereof; and, (g) comparator means (i) receiving said first, second and third output signals, (ii) comparing the actual value of the composition characteristic of said charge stock and the hydrogen concentration of said vaporous phase and (iii) generating fourth, fifth and sixth output signals; said control system being further characterized in that said computer means is in communication with said first, second and third flow-varying means via signal-transmitting means, which transmit said fourth, fifth and sixth comparator output signals thereto, whereby (i) the quantity of heat supplied to said preheating means, (ii) the quantity of said vaporous phase withdrawn from said process and, (iii) the flow of compressed vaporous phase from the discharge of said compressive means are adjusted in response thereto, and said hydrogen/hydrocarbon mole ratio is regulated.

In another embodiment, flow-sensing means senses the flow of said charge stock to said reaction zone, develops an output signal representative of the flow thereof and transmits the output signal to said comparator means which, in turn, transmits and output signal to fourth flow-varying means, whereby the flow of said charge stock is adjusted in response thereto.

In another specific embodiment, our invention involves a method for regulating the hydrogen/hydrocarbon mole ratio in the feed stream to the reaction zone of a continuous hydrocarbon conversion process, wherein (1) a hydrocarbonaceous charge stock is introduced into preheating means having fuel-supplying means associated therewith, (2) the resulting heated charge stock and hydrogen are contacted in a catalytic reaction zone, (3) a hydrogen-containing, hydrocarbon effluent stream is withdrawn from said reaction zone, (4) said effluent stream is condensed and separated to provide a vaporous phase and a liquid phase, (5) at least a first portion of said vaporous phase is recycled at increased pressure, via compressive means, to said reaction zone, and (6) a second portion of said vaporous phase is withdrawn from said conversion process via pressure control, which method comprises the steps of: (a) regulating the quantity of fuel-supplied to said preheating means by adjusting a first flow-varying means in said fuel-supplying means; (b) regulating the quantity of the second portion of said vaporous phase withdrawn from said conversion process by adjusting a second flow-varying means; (c) regulating the quantity of compressed vaporous phase flowing from the discharge of said compressive means to the suction thereof by adjusting a third flow-varying means; (d) introducing a sample of said hydrocarbonaceous charge stock into a first hydrocarbon analyzer and developing therein a first output signal representative of a composition characteristic of said sample; (e) introducing a sample of said separated liquid phase into a second hydrocarbon analyzer and developing therein a second output signal representative of a composition characteristic of said sample; (f) introducing a sample of said recycled vaporous phase into a third analyzer and developing therein a third output signal representative of the octane of said sample; (g) monitoring the pressure of said separated vaporous phase and developing a fourth output signal representative of said pressure; (h) transmitting said first, second, third and fourth output signals to comparator means which compares the rate of change thereof, and the actual values of the composition characteristics and the hydrogen concentration, and generating therein fifth, sixth, seventh and eigth output signals; and, (i) transmitting at least one of said fifth, sixth, seventh and eighth output signals to at least one of said first, second and third flow-varying means, whereby the flow of said fuel, said withdrawn excess vaporous phase and/or the flow of compressed vaporous phase from the discharge of said compressive means to the suction thereof is adjusted in response to said composition characteristics, hydrogen concentration and separated vaporous phase pressure, thereby regulating the hydrogen/hydrocarbon mole ratio in the feed stream to said reaction zone.

These, as well as other objects and embodiments of our invention, will become evident to those possessing the requisite expertise in the appropriate art from the following, more detailed description thereof.

PRIOR ART

The utilization and integration of sophisticated control systems into a petroleum refining process is generally considered to be among the more recent technological innovations. However, candor compels recognition of the fact that the published literature is steadily developing its own field of art. For example, U.S. Pat. No. 3,759,820 (Cl. 208-64) discusses the systematized control of a multiple reaction zone process in response to two different quality characteristics of the ultimately desired product. In a specific illustration involving the catalytic reforming of a naphtha charge stock, the two product qualities are the octane rating and the measured liquid yield. Output signals, representative of the two product qualities are utilized to regulate the reaction zone severities in response thereto. In U.S. Pat. No. 3,751,229 (Cl. 23-253A) the reaction zone severity in a catalytic reforming unit is controlled in response to the octane rating of the effluent liquid at the reaction zone pressure.

U.S. Pat. No. 3,756,921 (Cl. 196-132) discloses a control system for a gasoline splitter column utilizing an octane monitor in combination with flow-measuring means on both the overhead stream and the bottom stream. Override means are utilized to prevent the splitter column from emptying should excessive quantities of bottoms material be produced. Similarly, U.S. Pat. No. 3,755,087 (Cl. 196-100) discloses the control of a fractional distillation column operating as a gasoline splitter, by measuring the octane rating of the overhead fraction and adjusting the reflux to the column in response thereto.

Another illustration of the control of reaction zone severity in response to the octane rating of the liquid phase effluent from a catalytic reforming process is disclosed in U.S. Pat. No. 3,649,202 (Cl. 23-253A). In this illustration, the reaction zone severity in each of three reaction vessels is individually regulated in response to the octane rating and the temperature differential across each of the reaction zones.

The control system of the present invention likewise regulates operating severity in one or more reaction zones of a hydrocarbon conversion process. However, a significant improvement is afforded in that extended utilization of the catalytic composite disposed within the reaction zone, at its optimum activity, is achieved, and maximum volumetric yield of the target product slate is realized throughout the overall effective catalyst life. Our technique involves controlling the hydrogen/hydrocarbon mole ratio in response to changes in feed stock and product compositions, reaction zone effluent composition and the then current life of the catalyst, in order to attain target product quality over an extended period of effective catalyst activity.

Briefly, our preferred method involves analyzing the product for a composition characteristic, the charge stock for a composition characteristic and the recycled vaporous phase for hydrogen concentration, and sensing operating variables including reaction zone temperatures, pressure, flow rates, etc. Output signals representative of these items are transmitted to computer/-comparator means which generates additional output signals employed to regulate reaction zone severities, flow rates, etc.

SUMMARY OF INVENTION

A complete refinery within the petroleum industry comprises a multiplicity of hydrocarbon conversion processes integrated together for the principal purpose of attaining a particularly desired product slate. Such processes include the catalytic reforming of naphtha fractions to produce a relatively high octane liquid product, hydrocracking to produce lower molecular weight hydrocarbons, a portion of which can be utilized as the feed to the catalytic reforming unit, paraffinic dehydrogenation to produce olefins, hydrocarbon isomerization and hydrorefining for the purpose of contaminant removal, etc. Additionally, many refineries will include processes designed for the production of specific compounds finding utilization as petrochemicals. For example, aromatic isomerization to produce paraxylene, alkylation to produce alkyl-substituted aromatic hydrocarbons, etc. These processes involve hydrogen-consuming reactions, hydrogen-producing reactions, or both, and are generally effected by contacting the hydrocarbonaceous charge stock with a catalytic composite in a hydrogen-containing atmosphere at elevated temperature and pressure. In the interest of brevity, further discussion of our inventive concept, its function and the method for effecting the same, will be specifically directed to the well known and thoroughly documented catalytic reforming process. It is understood that such a specific discussion is not intended to limit the present invention beyond the scope and spirit of the appended claims.

In catalytic hydrocarbon conversion processes exemplified by the foregoing, and particularly in the catalytic reforming of naphtha fractions, the recycle of a hydrogen-rich vaporous phase, to combine with the fresh feed charge stock, is a common practice. Experience has indicated that this technique maintains a "clean" catalytic composite which promotes acceptable catalyst activity and the stability required to function effectively over an extended period of time. Whether considering a single-stage process, or a multiple-stage process, the recycled hydrogen-containing vaporous phase is obtained from the reaction zone effluent via high-pressure separation at a temperature in the range of about 60°F. to about 140°F. In a hydrogen-producing process, such as catalytic reforming, that portion of the separated hydrogen not required to maintain the hydrogen recycle is removed from the system and utilized elsewhere — i.e. in a hydrogen-consuming process such as hydrocracking.

In addition to reaction zone temperatures, pressures and space velocities, it is generally conceded that the hydrogen/hydrocarbon mole ratio of the combined feed to the reaction zone constitutes an extremely important operating variable. Constantly changing feed stock composition characteristics necessitate corresponding changes in the hydrogen/hydrocarbon mole ratio in order to maintain acceptable catalyst activity and stability. As the product quality and/or quality changes, the reaction zone severity, principally temperature and pressure, must necessarily be adjusted. This, however, further affects the hydrogen/hydrocarbon mole ratio.

In accordance with the present control method and system, a charge stock composition characteristic is sensed and the hydrogen concentration within the separated vaporous phase being introduced into the reaction zone is sensed. In a preferred system, a composition characteristic of the separated liquid product is also sensed. Appropriate output signals are transmitted to a comparator/computer which in turn generates computer output signals which are transmitted as required to adjust reaction zone severity (temperature and pressure), charge stock flow and recycle gas flow in order to regulate the hydrogen/hydrocarbon mole ratio. Additionally, output signals which are representative of reaction zone inlet and outlet temperatures and the pressure of the vaporous phase separated from the reaction zone product effluent are transmitted to the comparator/computer means. In this manner, the computer output signals are representative of all the operating variables which affect the hydrogen/hydrocarbon mole ratio, or partial pressure of hydrogen within the reaction zone, as well as the product quality and/or quantity.

Prior to the start-up of a catalytic reforming unit, or other hydrocarbon conversion process, the various operating variables are initially determined by preparing a yield estimate directed to a predictable product quality and/or quantity based upon a relatively detailed analysis of the hydrocarbonaceous charge stock. Charge stock analyses will generally include molecular weight, gravity, boiling range and the relative concentrations of paraffins, naphthenes and aromatic hydrocarbons. The estimated required hydrogen/hydrocarbon mole ratio is calculated and the computer/comparator means is appropriately programmed to maintain the indicated mole ratio. Changes in feed stock composition characteristics are transmitted to the computer/comparator, as is the flow rate thereof. The pressure and flow rate of the recycled vaporous phase, as well as the hydrogen concentration thereof, is also transmitted to the computer/comparator. The latter back-calculates the required hydrogen/hydrocarbon mole ratio and transmits appropriate output signals to achieve the values so indicated. A later change in the product quality and/or quantity is sensed and the computer/comparator means appropriately adjusts the furnace firing to regulate reaction zone temperatures and/or to adjust the operating pressure within the reaction zone, in order to re-attain the target product characteristics. The computer/comparator means then compares the resulting hydrogen/hydrocarbon mole ratio and again transmits appropriate output signals to achieve the optimum.

HYDROCARBON ANALYZERS

The control system of the present invention utilizes at least three analyzers, two of which serve to determine composition characteristics of principally liquid streams, and the third of which determines the hydrogen concentration in that portion of the separated vaporous material being recycled to the reaction zone. One of the hydrocarbon analyzers develops an output signal which is corollatable with the octane rating of the separated normally liquid stream. Complete details of this hydrocarbon analyzer, herein referred to as an "octane monitor," may be obtained upon reference to U.S. Pat. No. 3,463,613 (Cl. 23-230). As stated therein, a composition characteristic of a hydrocarbon sample can be determined by burning the same in a combustion tube under conditions which generate a stabilized cool flame. The position of the flame front is automatically detected and employed to develop a signal which, in turn, is employed to vary a combustion parameter, such as combustion pressure, induction zone temperature or air flow, in a manner which immobilizes the flame front regardless of changes in the composition characteristic of the hydrocarbon sample. The change in the combustion parameter, required to immobilize the flame front, following a change of sample composition, is corollatable with the composition characteristic change. An appropriate read-out device, connecting therewith, may be calibrated in terms of the desired identifying characteristic, such as the octane rating.

The hydrocarbon analyzer is conveniently identified as comprising a stabilized cool flame generator having a servo-positioned flame front. The type of analysis afforded thereby is not compound-by-compound analysis such as presented by instruments including mass spectrometers or vapor phase chromatographs, which can be employed as hereinafter set forth. On the contrary, the analysis is represented by a continuous output signal which is responsive to, and indicative of hydrocarbon composition and, more specifically, is corollatable with one or more conventional identifications or specifications of petroleum products such as Reid vapor pressure, ASTM or Engler distillations, boiling points, paraffin, naphthene and aromatic concentrations, paraffinicity, or, for motor fuels, antiknock characteristics such as research octane number, motor octane number, or a composite of such octane numbers.

Other examples of cool flame generators, having servo-positioned flame fronts, and their use in analyzing hydrocarbon compositions and monitoring the same, are illustrated in U.S. Pat. Nos. 3,533,745 (Cl. 23-230), 3,533,746 (Cl. 23-230) and 3,533,747 (Cl. 23-230). It is this type of hydrocarbon analyzer which is also preferred for monitoring one or more composition characteristics of the hydrocarbon charge stock including paraffinicity, boiling point and/or density and molecular weight.

With respect to the hydrogen concentration in the recycled vaporous phase, the chromatographic monitors disclosed in U.S. Pat. Nos. 3,097,517 (Cl. 73-23) and 3,257,847 (Cl. 73-23.1) are suitable. Additionally, a density monitor, calibrated to mole percent hydrogen, is suitable for utilization as the analyzer on the recycled vaporous stream. Still another suitable analyzer constitutes a differential pressure monitor which determines the partial pressure of hydrogen diffused through a hot palladium diaphragm. In any event, the two hydrocarbon analyzers and the hydrogen analyzer develop output signal representative of the composition characteristics and hydrogen concentration, which output signals are transmitted to computer/comparator means.

COMPUTER/COMPARATOR

The present control system and method for regulating the hydrogen/hydrocarbon mole ratio utilizes computer/comparator means which receives various output signals from the stream analyzers and operating variable indicators, generates additional computer output signals and transmits the same to various controls and/or control loops within the overall process. Signals received by the computer are compared with previously-received signals to determine the actual value of the stream composition characteristic and hydrogen concentration. Preferably, the computer also determines the rate of change thereof. Additional output signals, received by the computer, represent temperatures associated with the conversion zone, or zones, the flow rate of the fresh charge stock, the flow rate of the recycled vaporous phase, the temperature of the charge stock following heat exchange with a hot reaction zone effluent stream, the flow of total vaporous phase from the high-pressure separator and the pressure of the vaporous phase from the separator.

As hereinafter more thoroughly described with reference to the accompanying drawing, the computer, having been programmed to select the optimum hydrogen/hydrocarbon mole ratio, in response to all the signals received thereby, generates additional output signals which are transmitted to a control loop which effects adjustment of the fuel supplied to heating means into which the reaction zone charge is introduced, to charge stock flow control means, to control means which adjusts the flow of vaporous phase removed from the system, and to control means which regulates the quantity of compressed vaporous phase from the discharge of the compressive means, employed to circulate the hydrogenrich recycled vaporous phase. It may be that any one, or more of the additional computer output signals will indicate that no change is then required in any of the above-described variable controls. The computer/comparator means can include the appurtenances necessary for comparing the actual values of the signals received with previously determined deviation limits and for generating adjustment signals responsive to this comparison. For example, the practical maximum catalyst temperature in a catalytic reforming unit may be 1050°F. Should the comparator means indicate a trend to exceed the specified limit, the appropriate adjustment signal is transmitted. As another example of the integration of deviation limits, it will be presumed that the desired octane rating of the separated liquid phase is 91.0. The deviation limit might be set at 92.0 such that an adjustment signal is transmitted should other computer output signals tend to indicate an ultimate deviation.

BRIEF DESCRIPTION OF DRAWING

The accompanying drawing illustrates several embodiments of the present control system integrated into a multiple-stage catalytic reforming process. The drawing comprises FIG. 1 and its continuation FIG. 1A. It is not intended that our invention be unduly limited thereby beyond the scope and spirit of the appended claims. Modifications to the diagrammatic sketch will become evident to those having the requisite skill in the appropriate art.

The illustrated catalytic reforming process is a three-stage unit comprising reaction zones 7, 11 and 15. Included are heat exchanger 3, charge heater 5, interheaters 9 and 13, compressor 24 and high-pressure separator 20. Computer/comparator 31 receives various output signals via instrument lines 30, 51, 54, 58, 73, 76, 80, 38, 93, 96, 99, 105, 108, 115 and 35, generates additional computer output signals and transmits the same via instrument lines 48, 60, 63, 90, 102 and 116. Hydrocarbon analyzer 28 receives a sample of the charge stock from line 1, develops an output signal representative of a composition characteristic thereof and transmits said output signal via instrument line 30 to computer/comparator 31. Analyzer 37 receives a sample of the recycled hydrogen-rich vaporous phase in line 2, develops an output signal representative of the hydrogen content and transmits said signal via instrument line 38.

Figure 1:
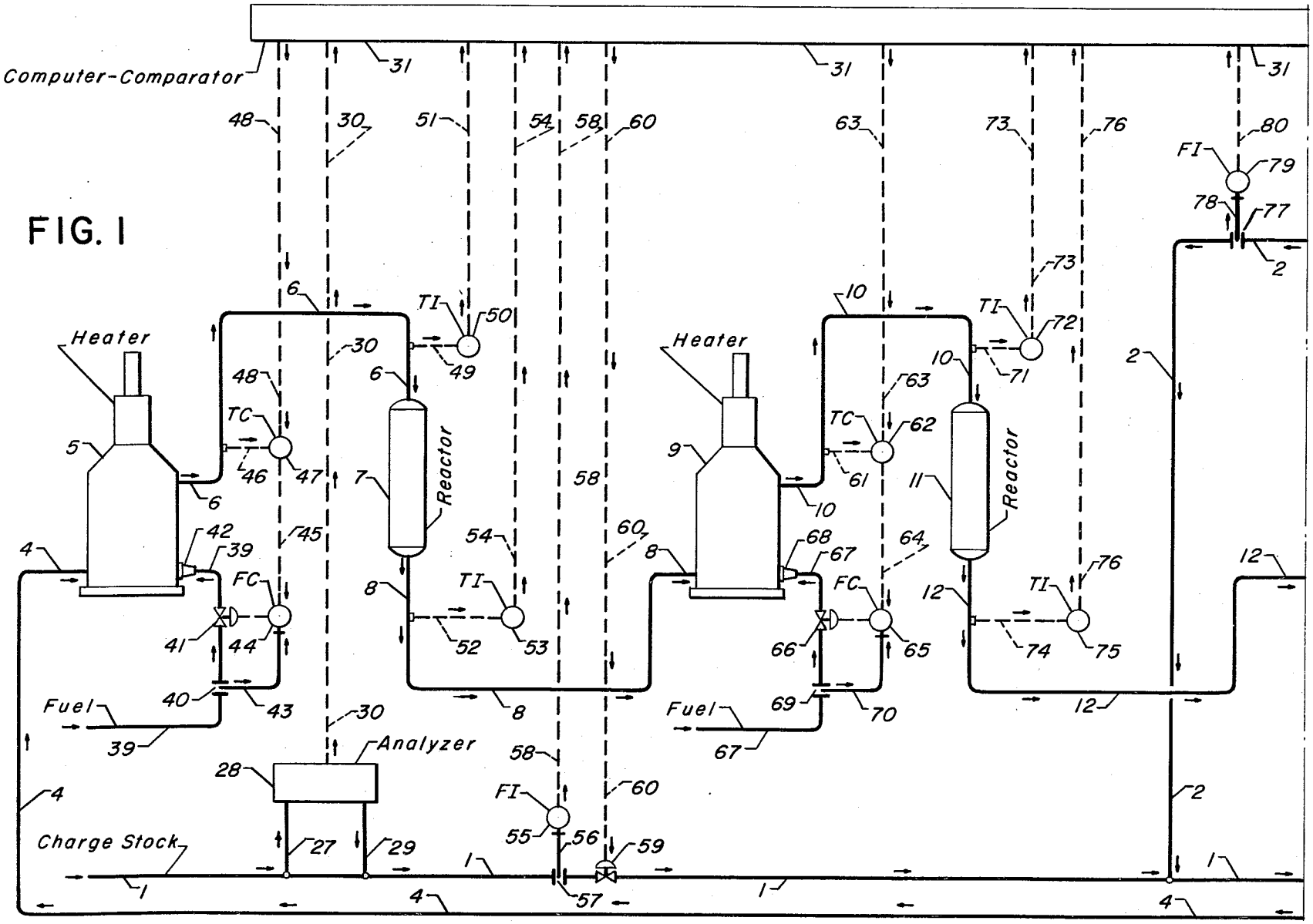
Figure 1A:
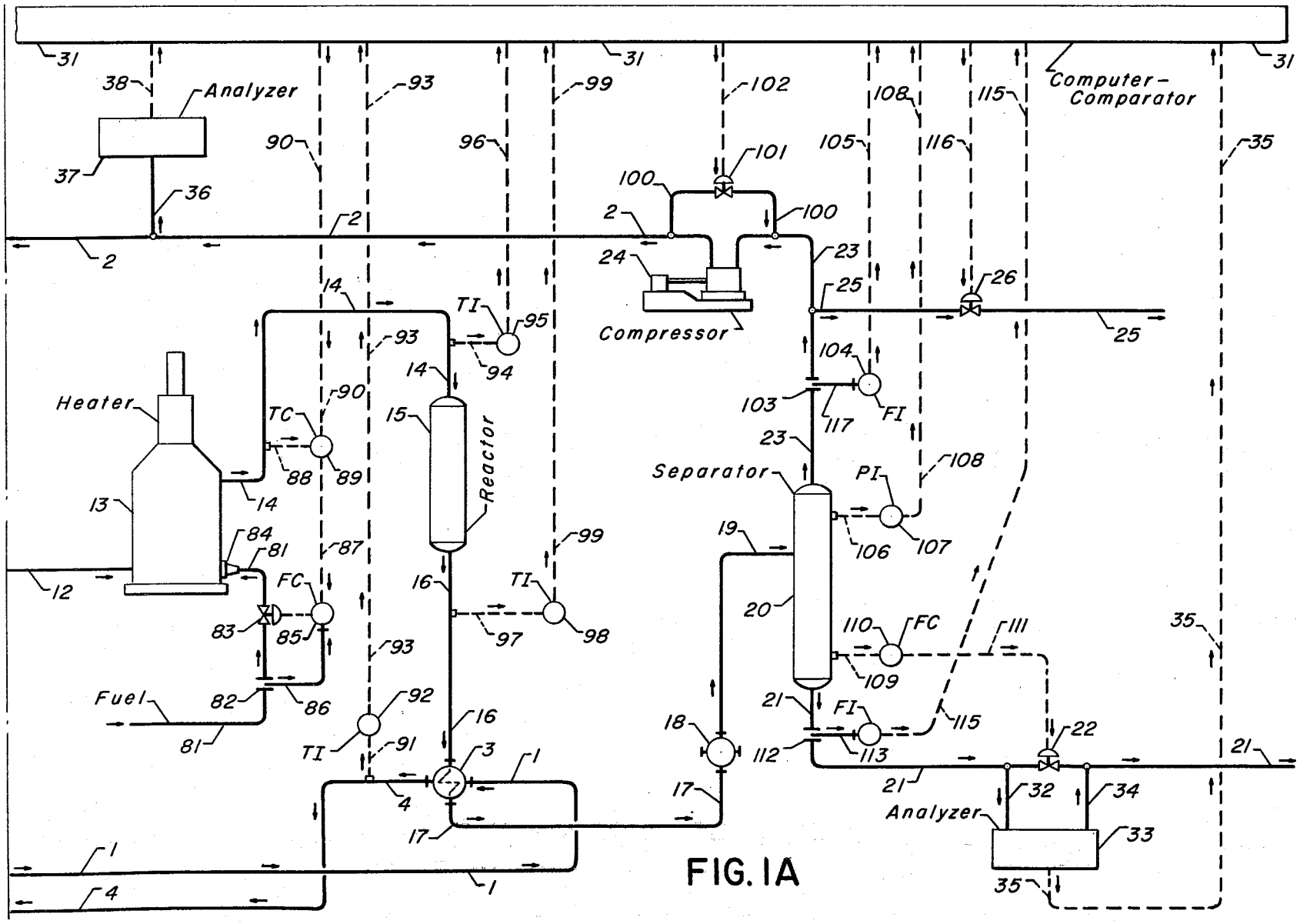

Since the illustrated process is catalytic reforming, hydrocarbon analyzer 33 is an octane monitor which utilizes a stabilized cool flame generator having a servo-positioned flame front. The flow of oxidizer (air) and fuel (sample of separator liquid phase from line 21, via line 32) are fixed, as is the induction zone temperature. Combustion pressure is the parameter which is varied in such a manner that the stabilized cool flame front is immobilized. Upon experiencing a change in octane rating of the separated liquid phase, the change in pressure required to immobilize the cool flame front provides a corollatable direct indication of the octane rating change. Typical operating conditions for octane monitor 33 are: air flow, 3,500 cc./min. (STP); fuel flow, 1.0 cc./min.; combustion pressure, 4.0 to 20.0 psig.; and, octane rating range (unleaded), 80 to 102. The actual calibrated span of the octane monitor as herein utilized will, in general, be considerably narrower. For example, if the target octane (research method clear) is 92.0, a suitable span might be 89.0 to about 95.0. When the relatively narrow span is employed, the octane rating change is essentially directed proportional to the change in combustion pressure.

As previously set forth, catalytic reforming, whether fixed-bed, or continuous, is effected in a multi-stage system at catalyst temperatures of 800°F. to about 1100°F., although most operations are conducted at 850°F. to about 1050°F. The quantity of hydrogen-rich recycled vaporous phase is such that the hydrogen/hydrocarbon mole ratio is in the range of about 1.0 to 20.0. Pressures in the range of 100 to 1,500 psig. are employed, and the charge stock contacts the catalyst at a liquid hourly space velocity of about 0.5 to about 15.0.

The selection of the catalytic composite, for use in the reforming reaction zones, is principally determined after a detailed analysis of the naphtha feed stock and a yield estimate based thereon, and is directed toward the target product quality and quantity. Generally, although the catalyst is "tailored" for a specific use, alumina, containing a Group VIII noble metal is used. Platinum appears to be the most suitable, although palladium, osmium, iridium, rhodium and ruthenium may be employed, and in admixture with platinum. Relatively recent investigations have indicated that the addition of one or more non-noble metals, to produce bi-metallic, tri-metallic, or tetra-metallic catalysts, improves activity and stability. Such non-noble metals include tin, rhenium, germanium, nickle, cobalt, gold, etc. The precise composition of the reforming catalyst does not constitute a feature essential to our invention.

As comprehension and understanding of the reaction mechanisms involved in the catalytic reforming of naphtha fractions has increased, it has become possible to correlate operating techniques and conditions with specific catalytic compositions, consistent with the charge stock properties, to enhance the attainment of the target product quality and quantity. The principal purpose of catalytic reforming is to subject a substantially contaminant-free gasoline boiling range feed stock to elevated temperature and pressure, in the presence of hydrogen, in order to enhance the anti-knock properties thereof. This enhancement, resulting in a relatively high-octane gasoline product, is primarily derived from four specific chemical reactions: (1) the dehydrogenation of naphthenic hydrocarbons to produce the corresponding aromatic hydrocarbons; (2) the dehydrocyclization of paraffinic hydrocarbons to produce additional aromatic hydrocarbons; (3) the hydrocracking of high molecular weight hydrocarbons to produce lower molecular weight hydrocarbons; and, (4) the isomerization of normal paraffinic hydrocarbons to produce branched-chain isomers.

Each of the foregoing reaction mechanisms upgrade low octane hydrocarbons to higher octane hydrocarbons; however, as the automotive industry has increased engine compression ratios, it has become necessary to adjust operating techniques and develop new catalysts in order to control the reaction mechanism selectively while simultaneously maximizing product octane rating with minimum loss of liquid yield. Regardless of the composition characteristics of the catalytic composite, it has been determined and acknowledged that the dehydrogenation of naphthenes is promoted at lower pressure levels; the dehydrogenation of paraffins to aromatics is promoted at relatively lower pressures and elevated temperatures; hydrocracking of paraffins is promoted both by elevated pressure, elevated temperature and relatively long residence time of the charge stock on the catalyst; and, isomerization of paraffins is promoted at some intermediate temperature. In view of the fact that aromatic hydrocarbons have significantly higher octane ratings than other hydrocarbons of equivalent molecular weight, current catalytic reforming processes have shown the tendency to operate at higher temperatures and lower pressures. Therefore, the catalytic reforming units have typically been maintained at operating conditions sufficient to enhance the dehydrogenation of naphthenes and the dehydrocyclization of paraffins in order to maximize the production of both aromatic hydrocarbons and hydrogen, the latter being desired since it is normally consumed elsewhere in the overall refinery operation.

Problems and difficulties attendant the control of catalytic reforming to judiciously enhance the effective life of the catalytic composite — generally defined as barrels of charge stock per pound of catalyst within the system — continue to be numerous. Some of these have been effectively solved and eliminated through the integration of control systems and automatic sampling devices. For example, operating "in the dark" until manual product analyses are available, and operator guess work, have been alleviated to a great extent by the control of reaction zone severity consistent with product octane rating, as shown in U.S. Pat. No. 3,649,202 (Cl. 23-253A). However, other problems and difficulties remain, and stem from a myriad of aspects including a constantly changing charge stock composition with its accompanying effect upon product quality. Varying compositions of the reaction zone total effluent further affect product quality and quantity and the severity of operation within the reaction system as a result of the varying compositions of the vaporous and liquid phases separated within the high-pressure separator. Also to be considered is the normal deterioration of the active metallic components within the catalytic composites, the rate of which is decelerated through the use of recycled hydrogen in amounts based upon the flow of fresh charge stock. In view of these, continuously meeting target product quality and quantity, while simultaneously extending the effective life of the selected catalyst remains a dilemma to plague the refiner. Controlling the hydrogen/hydrocarbon mole ratio in accordance with the present invention effectively solves the problems and thus avoids the attendant difficulties.

DETAILED DESCRIPTION OF DRAWING

Our method for controlling the hydrogen/hydrocarbon mole ratio in a catalytic hydrocarbon conversion process, and the control system therefor, will be more clearly understood with reference to the accompanying diagrammatic sketch. Although the drawing is directed toward a multistage, fixed-bed catalytic reforming process, it is equally well suited for the recently-developed multi-stage, continuously-regenerated process as exemplified in U.S. Pat. No. 3,647,680 (Cl. 208-65). Furthermore, as hereinbefore stated, the illustration directed toward catalytic reforming is not intended to limit our invention thereto. In the drawing, process flow lines, including sample taps, and major items of equipment are therein illustrated by solid lines, while the dashed lines represent signal transmitting means to and from the computer/comparator, and in the indicated cascade control loops.

With reference now to the drawing, a low octane rating feed stock, comprising naphtha, or gasoline boiling range hydrocarbons, having an end boiling point of about 350°F. to about 380°F., is introduced into the process by way of line 1. A hydrogen-rich, principally vaporous phase from line 2 is admixed therewith, the mixture continuing through line 1 into heat exchanger 3. Heat exchanger 3 is an indirect heat exchanger generally of the tube and shell type. The heating medium is relatively hot reaction zone effluent introduced thereto via line 16. The thus-preheated mixture of hydrocarbons and hydrogen are introduced via line 4 into a direct-fired furnace heater 5. Although heater 5 may be any type of heat exchanger employing various heating media such as steam, hot oil, hot vapor, flue gas, etc., in order to achieve the high temperature required, the heater will be a direct-fired furnace as illustrated.

The heated reaction mixture is withdrawn by way of line 6, typically at a temperature in the range of about 850°–1100°F., depending upon the composition of the hydrocarbon feed stock, and is introduced thereby into reactor 7. The hot mixture passes into reaction zone 7 at a pressure of about 100 to about 500 psig., and typically at a pressure of about 250 psig., and contacts therein a fixed-bed of noble metal-containing reforming catalysts. The principal reaction being effected in reactor 7 constitutes the dehydrogenation of naphthenic hydrocarbons to produce aromatic hydrocarbons, which reaction is endothermic. Consequently, the reaction zone effluent emanating via line 8 is at a temperature lower than the reaction zone inlet temperature, and generally from about 60°F. to about 150°F. The degree of temperature drop within reactor 7 is generally dependent upon the naphthenic content of the fresh hydrocarbonaceous charge stock, the inlet temperature of the catalyst bed, the hydrogen to hydrocarbon mole ratio within the conversion zone and the imposed pressure.

In view of the pressure drop experienced in reaction zone 7, the effluent in line 8 is introduced into a second direct-fired heater 9 in order to increase the temperature thereof. The heated reaction mixture is withdrawn via line 10, again typically at a temperature in the range of about 850°F. to about 1100°F., and introduced thereby into reactor 11. Reaction zone 11 will function at a pressure somewhat less than that within reaction zone 7 as a result of the pressure drop normally experienced as a result of the flow of fluids through intervening equipment and the catalyst bed within reaction zone 7. Reaction zone 11 also contains a fixed-bed of noble metal-containing reforming catalyst, which may or may not be of the same composition as that in reaction zone 7. The reactant mixture undergoes additional conversion by way of further dehydrogenation of naphthenes and dehydrocyclization of paraffins to produce aromatic hydrocarbons, as well as some isomerization of normal paraffins to the corresponding isoparaffins. Accordingly, the overall reaction is endothermic and, consequently, the reaction mixture leaves reactor 11 via line 12 at a temperature generally about 20°F. to about 100°F. lower than the temperature at the inlet to reactor 11. The degree of endothermicity of the reactions being effected in reaction zone 11 primarily depends upon the remaining naphthene content of the reaction mixture, as well as the operating conditions existing therein.

The effluent from reactor 11 is introduced via line 12 into a third direct-fired heater 13 in order to increase the temperature thereof. Again, the temperature will generally be in the range of about 850°F. to about 1100°F., although in many situations the increased temperature will be about 10°F. greater than that of the reactant stream entering reaction zones 7 and 11. The thus-heated reactant mixture is introduced via line 14 into reactor 15. The pressure at the inlet to reactor 15 will be substantially the same as that at the inlet to reactor 11, allowing only for the pressure drop resulting from the flow of fluids through intervening equipment and the catalyst bed. The catalyst, disposed as a fixed-bed in reactor 15 contains a noble metal component, and may be of the same, or different composition as that catalyst disposed in reactors 7 and 11. Since the major proportion of naphthene dehydrogenation and paraffin dehydrocyclization has been effected in reactors 7 and 11, the reactions effected in reactor 15 will predominantly involve the hydrocracking of relatively long-chain paraffins into relatively short-chain paraffins. Consequently, the overall temperature differential will indicate either a slightly endothermic, or a slightly exothermic reaction. Accordingly, the reaction effluent emanating from reactor 15 via line 16 will be at a temperature normally from about 10°F. below the reactor inlet temperature to about 10°F. above the reactor inlet temperature.

The effluent from the last reaction zone, reactor 15, passes through line 16 into heat exchanger 3 wherein it is utilized as a heating medium to initially preheat the fresh feed charge stock and recycled hydrogen prior to the introduction thereof into direct-fired heater 5. The resulting cooled reaction zone effluent is introduced via line 17 into condenser 18 wherein normally liquid hydrocarbon constituents thereof are condensed. The condensed mixture, at a temperature in the range of about 60°F. to about 140°F., and normally at a temperature of about 100°F., passes through line 19 into high-pressure separator 20. Separator 20 will function at a pressure slightly less than that of reactor 15, again due to intervening equipment and the catalyst bed therein. With respect to that portion of the process thus far described, where the initial pressure at the inlet of reaction zone 7 is in the range of about 100 to about 500 psig., separator 20 will normally be at a pressure about 50 psig. less — i.e. where the inlet pressure at reactor 7 is 300 psig., separator 20 will function at a pressure of about 250 psig.

The cooled and condensed reaction zone effluent entering separator 20 via line 19, is separated therein into a hydrogen-rich vaporous phase and a principally liquid phase. The vaporous phase is withdrawn by way of line 23, and introduced thereby into compressive means 24. Compressive means 24 discharges the recycled portion of the hydrogen-rich gas by way of line 2, to be combined with the fresh feed charge stock in line 1. The discharge pressure will, of course, be slightly higher than the pressure at the inlet to reactor 7. Excess hydrogen, in addition to relatively minor quantities of the lower molecular weight hydrocarbons, is removed from the system by way of line 25, containing control valve 26. This excess hydrogen is generally introduced into other functioning units within the overall refinery and particularly hydrogen-consuming units.

The condensed, normally liquid hydrocarbon phase, separated in high-pressure separator 20 is withdrawn via line 21, containing control valve 22, and transported thereby to suitable fractionation, or stabilization facilities for the removal therefrom of dissolved hydrogen and normally gaseous hydrocarbons. Withdrawal of the principally liquid phase is adjusted and controlled through the use of a liquid-level control system consisting of level-sensing means transmitting a level output signal via instrument line 109 to flow controller 110 which, in turn, regulates the operation of control valve 22 by transmitting an appropriate signal through instrument line 111. The level-sensing means may be a floating lever mechanism, a dielectric probe, a DP cell, or any similar device capable of maintaining a preset liquid level seal in the lower portion of high-pressure separator 20. Flow controller 110 regulates valve 22 by transmitting an electrical, pneumatic or similar output signal thereto.

In the preferred illustrated embodiment, hydrocarbon analyzer 33, in this illustration directed toward the catalytic reforming process, an octane monitor, utilizing a stabilized cool flame generator having a servo-positioned flame front, is field-installed immediately adjacent high-pressure separator 20. A sample loop connects octane monitor 33 with the normally liquid separator bottoms material in line 21, and consists of line 32 which removes a sample at a rate of about 100 cc. per minute, and line 34 which returns excess sample at a rate of about 99 cc. per minute. The sample itself is drawn off the octane monitor from some intermediate portion of the sample loop and injected at full line pressure and a carefully controlled rate of 1.0 cc. per minute into the combustion zone of octane monitor 33. Since the liquid phase sample, injected into the combustion zone, is substantially at the same pressure level as the last reaction zone, it contains liquid hydrocarbons, dissolved hydrogen and dissolved low molecular weight, normally vaporous hydrocarbons. However, the output signal of the monitor can be, and preferably is calibrated directly in terms of octane number, notwithstanding the presence of a substantial portion of high vapor pressure constituents within the sample. The output signal from octane monitor 33 is then transmitted, via line 35, to computer 31 which is operatively responsive to the octane monitor output signal, and which, in turn, develops a computer output signal which is a function of the octane number of the sample withdrawn from line 21.

The location of octane monitor 33, that is, sampling the separator bottoms material at the separator pressure level, thus assures that the liquid phase of the reaction zone effluent (the unstabilized gasoline being transported to the stabilizer column) will always remain on specification, relative to octane number, regardless of external upsets or disturbances. The sample transport lag, or dead time, of a close-coupled octane monitor, as employed within the present illustration, is of the order of about two minutes or less, and its response time is another two minutes. This provides close proximity to an essentially instantaneous, or real-time output. With so little dead time built into the closed loop, controlled stability is achieved and maintained, and undampened cycling is virtually eliminated.

In order to effect optimum control of the hydrogen/hydrocarbon mole ratio within the reaction zones, computer/comparator 31 receives a number of other output signals, in addition to that representative of the octane rating of the liquid phase in line 21, which are indicative of operating conditions within the process and composition characteristics.

Process output signals, or input signals to the computer/comparator, include one which is representative of at least one composition characteristic of the hydrocarbonaceous feed stock in line 1. A 100 cc./min. sample of the feed stock is withdrawn through line 27, introduced into hydrocarbon analyzer 28, with the excess being returned via line 29. Suitable composition characteristics include boiling point, density, hydrocarbon type, etc. Of these, the paraffinicity (paraffin content) of the feed stock is preferred, since changes therein will have the greatest bearing upon product quality and quantity, and the hydrogen/hydrocarbon mole ratio. It is, of course, within the scope of our inventive control system to utilize a plurality of analyzers in order to monitor several feed stock characteristics. Thus, instrument line 30 will transmit one or more output signals which are representative of one or more charge stock composition characteristics. Of course, the more processing output signals transmitted to the computer/comparator, the closer the control of the hydrogen/hydrocarbon mole ratio.

In order to effect control of the hydrogen/hydrocarbon mole ratio, the concentration of hydrogen in the vaporous phase being recycled within the process must be known. That is, analyzer 37 develops an output signal which is representative of, and corollatable with the hydrogen content in the vaporous phase in line 2. The sample is introduced by way of line 36, and the representative output signal transmitted from analyzer 37 via instrument line 38. As hereinbefore described, analyzer 37 is only required to produce an output signal representative of the hydrogen concentration and, therefore, may be selected from a variety of suitable devices described in the art. For example, a density monitor, calibrated to percent hydrogen, can be employed; a chromatographic monitor is also suitable, but somewhat less preferred; or, a differential pressure monitor determining the partial pressure of hydrogen diffused through a hot palladium diaphragm.

Other processing output signals developed and transmitted to computer 31, involve operating variables, and are utilized to further refine the present control system, and thus enhance the overall operation of the process. One principal operating variable is the pressure at which the recycled vaporous phase is separated from the reaction zone effluent in high-pressure separator 20. The output signal representative thereof is sensed, via line 106, by pressure indicator 107, and transmitted to computer/comparator 31 through instrument line 108. Additionally, flow indicator 55 senses the rate of flow of charge stock through line 1, by way of line 56, as metered by flow-determining means 57, the latter being a venturi, orifice, turbine meter, or other suitable device. The output signal representative of the charge stock flow rate is transmitted via line 58. Likewise, the rate of flow of the hydrogen-rich vaporous phase, being recycled via line 2, is measured and sensed by flow-determining means 77, line 78 and flow indicator 79; the output signal is transmitted via line 80. Although not essential to the present control system, but preferred from the viewpoint of overall process operation, are the flow rates of the liquid and vaporous phases separated in high-pressure separator 20. The former is measured by flow-determining means 112, transmitted via line 113 to flow indicator 114, the output signal from which is transmitted via line 115 to computer 31. Where the refiner is not only interested in product quality (octane number), but also in maximizing the so-called "octane-barrel," this representative output signal attains a degree of relevance in the functioning of computer 31 to ascertain the proper computer output signals. The flow rate of the vaporous phase separated and withdrawn through line 23, is measured by flow-determining means 103 which transmits a signal via line 117 to flow-indicator 104, the output signal from which is, in turn, transmitted to computer/comparator 31 by way of instrument line 105.

Other output signals, indicative of processing conditions within the reaction zones of the illustrated conversion process, are representative of various temperatures therein. One such temperature is that of the combined feed stream which is preheated in heat exchanger 3, and introduced into direct-fired heater 5 through line 4. The temperature of the preheated stream is sensed via line 91 and temperature indicator 92; the latter transmits a representative output signal to computer/comparator 31 via instrument line 93. The inlet and outlet temperatures of each of the three reaction zones are sensed, and appropriate signals transmitted to computer/comparator 31. As previously stated, the temperature differential (delta-T) across each catalyst bed is an important variable with respect to product specifications and catalyst activity and stability. The delta-T across the catalyst bed in reactor 7 is determined by the inlet temperature sensed by temperature-sensing means 49 and temperature indicator 50, and the outlet temperature sensed by temperature-sensing means 52 and temperature indicator 53; the representative output signals are transmitted through instrument lines 51 and 54, respectively. Similarly, with respect to reactor 11, the delta-T is determined by the inlet temperature sensed by temperature-sensing means 71 and temperature indicator 72, and the outlet temperature sensed by temperature-sensing means 74 and temperature indicator 75; the representative output signals are transmitted to computer/comparator 31 via instrument lines 73 and 76, respectively. Likewise, the delta-T across the last reaction zone, reactor 15, is calculated by sensing the inlet temperature via temperature-sensing means 94 and temperature indicator 95, the output signal being sent by way of line 96, and the outlet temperature sensed by temperature-sensing means 97 and indicator 98, the representative output signal being transmitted via instrument line 99.

Computer/comparator 31 is internally programmed to be responsive to the various output signals developed within the process, and to develop and generate computer output signals utilized to make the necessary adjustments within the process in order to control the hydrogen/hydrocarbon mole ratio, consistent with liquid product quality and quantity, or octane-barrel, and thus maintain an extended period of acceptable catalyst activity. Computer output signals 48, 63 and 90 are generated in a manner sufficient to adjust temperature levels within the three reaction zones 7, 11 and 15. Heat input to each of the three reaction zones is provided by introducing a suitable combustible fuel into each of the three direct-fired heaters 5, 9 and 13. The fuel, which may be liquid, gas, or a mixture thereof, is burned within the combustion zone, and the hot combustion gas passes through the furnace and out the refinery stack. Heat input to the reactant mixture is controlled by adjusting the rate of fuel flow to the direct-fired heater. Considering direct-fired heater 5, fuel is introduced thereto via line 39 and combustion nozzle 42. The control thereof is achieved by a flow-control loop comprising flow-sensing means 40 — i.e. a turbine meter —, control valve 41, flow controller 44 and flow signal line 43 which transmits the flow signal from sensing means 40 to controller 44. Flow controller 44, which is equipped with an automatically adjustable set point, then transmits an appropriate adjustment signal to control valve 41.

In addition to the flow-control loop provided in the fuel introduction system of each direct-fired heater, there is preferably associated therewith, in cascade fashion, a temperature recorder-controller also having an automatically adjustable set point, and which senses the temperature of the reactant mixture emanating from the direct-fired heater. Referring to heater 5, there is shown thermocouple means 46, contained in reactor inlet line 6, transmitting a temperature signal to temperature controller 47. Controller 47 produces an output signal which is transmitted by way of line 45 to flow controller 44 to adjust, or reset the automatically adjustable setpoint thereof. Temperature controller 47, also having an adjustable setpoint, receives the appropriate computer output signal via line 48. Computer/comparator 31 thus adjusts the temperatures associated with reactor 6 by resetting the setpoint of temperature controller 47 which, in turn, resets the automatically adjustable setpoint of flow controller 44.

With respect to direct-fired heater 9, fuel is supplied thereto by way of line 67 and combustion nozzle 68. The associated flow-control loop comprises flow-measuring means 69, flow controller 65, control valve 66 and flow signal transmitting line 70. In cascade arrangement with flow controller 65, is temperature recorder-controller 62 which receives a temperature signal from thermocouple means 61 installed in line 10. Both temperature controller 62 and flow controller 65 are equipped with automatically adjustable setpoints. The appropriate computer output signal is transmitted via line 63 to reset the setpoint of temperature controller 62; the latter, by way of instrument line 64, resets the setpoint of flow controller 65 which, in turn, appropriately adjusts control valve 66 to regulate the flow of fuel into heater 9 via line 67.

Similarly, direct-fired heater 13 is equipped with a fuel-supply flow-control loop. The flow of fuel in line 81, which is introduced into heater 13 via combustion nozzle 84, contains flow-measuring means 82 and control valve 83. The flow-measuring means 82 transmits a flow signal via line 86 to flow controller 85 which has an automatically adjustable setpoint. Thermocouple means 88 senses the temperature of the heater effluent in line 14 and transmits a temperature signal to temperature controller 89, which also has an automatically adjustable setpoint and is in cascade arrangement with flow controller 85 via instrument line 87.

In addition to the computer output signals described above, provision is made in the computer program to regulate the fresh feed charge stock flow rate, the flow rate of the hydrogen-rich recycled vaporous phase and the quantity of vaporous phase removed from the process through line 25 containing control valve 26. Flow indicator 55 transmits an output signal, representative of the charge stock flow rate, to computer/comparator 31 via instrument line 58. This signal is considered in determining the required adjustments to achieve the then best hydrogen/hydrocarbon mole ratio, an appropriate computer output signal is transmitted by way of instrument line 60 to adjust flow control valve 59, thereby either increasing, or decreasing the flow of feed stock through line 1. Similarly, the flow rate of the recycled gaseous phase is sensed by flow indicator 79, a representative signal is developed and transmitted via instrument line 80. This signal is considered in conjunction with that representative of the separator pressure, being sensed by pressure indicator 107 and transmitted via instrument line 108, is employed to develop computer output signals in lines 102 and 116. The latter signal adjusts control valve 26, in line 25, to regulate the quantity of separated vaporous phase removed from the system. The former signal, line 102, is used to adjust flow-varying means and regulate the quantity of recycled gas discharged from the compressor 24 via line 2. Any suitable flow-varying means may be employed; for example, pressure drop, compressor speed, etc. Illustrated is a preferred technique where the flow-varying means is control valve 101 which is adjusted to regulate the amount of spillback through line 100. In this fashion, the reaction zone pressure and the flow rate of the recycled vaporous phase is adjusted in a manner consistent with the various other signals received by computer/comparator 31 to control the hydrogen/hydrocarbon mole ratio at the optimum level to maintain (1) product quality and quantity, and (2) catalyst activity and stability.

From the foregoing discussion, the method by which the present control system is effected is readily apparent to those having the requisite expertise in the appropriate art. Also, the benefits and advantages will be easily recognized. Principal among the advantages is the continuous monitoring and control system which enhances catalyst stability and maintains catalyst activity by controlling reaction zone hydrogen/hydrocarbon mole ratio at that optimum consistent with product quality and quantity. The previously-described prior art control systems which monitor only the octane rating of the high-pressure separator liquid phase, and adjust only the reaction zone severity (temperature) in response thereto, necessarily must accept whatever effective catalyst activity and stability results. To the contrary, the present control system focuses upon hydrogen/hydrocarbon mole ratio to enhance catalyst stability, or extend the period of time that the catalyst functions acceptably, while simultaneously attaining the desired product quality and quantity. Our invention recognizes the necessity of additionally monitoring characteristics of the charge stock and its rate of flow, as well as the flow and hydrogen content of the recycled vaporous phase.

We claim as our invention:

1. In a continuous hydrocarbon conversion process wherein (1) a hydrocarbonaceous charge stock is introduced into preheating means having heat-supplying means associated therewith, (2) the resulting heated charge stock and hydrogen are contacted in a catalytic reaction zone, (3) a hydrogen-containing, hydrocarbon effluent stream is withdrawn from said reaction zone, (4) said effluent stream is condensed and separated to provide a vaporous phase and a liquid phase, (5) at least a first portion of said vaporous phase is recycled at increased pressure, via compressive means, to said reaction zone, and (6) a second portion of said vaporous phase is withdrawn from said conversion process via pressure control, the control system for regulating the hydrogen/hydrocarbon mole ratio of the combined hydrogen-charge stock feed to said reaction zone, which comprises, in cooperative combination:

a. first flow-varying means for adjusting the quantity of heat supplied to said preheating means;
b. second flow-varying means for adjusting the quantity of the second portion of said vaporous phase withdrawn from said conversion process;
c. third flow-varying means for adjusting the flow of compressed vaporous phase recycled from the discharge of said compressive means;
d. a first hydrocarbon analyzer receiving a sample of said hydrocarbonaceous charge stock and developing a first output signal representative of a composition characteristic thereof;
e. a second analyzer receiving a sample of that portion of said vaporous phase recycled to said reaction zone and developing a second output signal representative of the hydrogen concentration thereof;
f. means for sensing the pressure of the separated vaporous phase and developing a third output signal representative thereof;
g. a third hydrocarbon analyzer receiving a sample of said liquid phase and developing a fourth output signal representative of the octane thereof; and,
h. comparator means (i) receiving said first, second, third and fourth output signals, (ii) comparing the actual value of the composition characteristic of said charge stock and the hydrogen concentration of said vaporous phase and (iii) generating fifth, sixth, seventh and eighth output signals;

said control system being further characterized in that said comparator means is in communication with said first, second and third flow-varying means via signal-transmitting means, which transmit said fifth, sixth, seventh and eighth comparator output signals thereto, whereby (i) the quantity of heat supplied to said preheating means, (ii) the quantity of said vaporous phase withdrawn from said process and, (iii) the flow of compressed vaporous phase from the discharge of said compressive means are adjusted in response thereto, and said hydrogen-hydrocarbon mole ratio is regulated.

2. The control system of claim 1 further characterized in that said first and third hydrocarbon analyzers comprise stabilized cool flame generators having servo-positioned flame fronts.

3. The control system of claim 1 further characterized in that said third flow-varying means adjusts the flow of compressed vaporous phase from the discharge of said compressive means to the suction thereof.

4. The control system of claim 1 further characterized in that the first output signal is representative of the boiling point of said charge stock.

5. The control system of claim 1 further characterized in that the first output signal is representative of the density of said charge stock.

6. The control system of claim 1 further characterized in that the first output signal is representative of the paraffinicity of said charge stock.

7. The control system of claim 1 further characterized in that flow-sensing means senses the flow of said charge stock to said reaction zone, develops a ninth output signal representative of the flow thereof and transmits said ninth output to said comparator means.

8. The control system of claim 7 further characterized in that said comparator means transmits a tenth output signal to fourth flow-varying means, whereby the flow of said charge stock is adjusted in response thereto.

9. The control system of claim 1 further characterized in that first temperature-sensing means senses a first temperature within said reaction zone, develops an eleventh output signal representative thereof and transmits said eleventh output signal to said comparator means.

10. The control system of claim 9 further characterized in that the comparator means transmits an output signal to said first flow-varying means, which output signal is a function of said reaction zone temperature and the octane of said liquid phase.

11. The control system of claim 10 further characterized in that said first flow-varying means comprises a flow control loop having a flow controller with an adjustable setpoint regulating the supply of heat to said preheating means, whereby said setpoint is adjusted in response to said comparator output signal.

12. The control system of claim 11 further characterized in that (i) temperature-controlling means, having an adjustable setpoint, develops an output signal representative of the temperature of the heated charge stock from said preheating means, and transmits said output signal to said flow controller, whereby the setpoint thereof is adjusted in response thereto, and (ii) the comparator output signal is transmitted to said temperature-controlling means, whereby the setpoint thereof is adjusted in response thereto.

13. The control system of claim 9 further characterized in that second temperature-sensing means senses a second temperature within said reaction zone, develops a twelfth output signal representative thereof and transmits said twelfth output signal to said comparator means.

14. The control system of claim 13 further characterized in that the comparator means transmits an output signal to said first flow-varying means, which output signal is a function of said first and second temperatures and the octane of said separated liquid phase.

15. The control system of claim 13 further characterized in that said first temperature-sensing means senses a first temperature in an outlet section of said reaction zone, said second temperature-sensing means senses a second temperature in an inlet section of said reaction zone and said comparator means transmits an output signal to said first flow-varying means, which output signal is a function of the difference between said first and second temperatures and the octane of said separated liquid phase.

16. A method for regulating the hydrogen/hydrocarbon mole ratio in the feed stream to the reaction zone of a continuous hydrocarbon conversion process, wherein (1) a hydrocarbonaceous charge stock is introduced into preheating means having fuel-supplying means associated therewith, (2) the resulting heated charge stock and hydrogen are contacted in a catalytic reaction zone, (3) a hydrogen-containing, hydrocarbon effluent stream is withdrawn from said reaction zone, (4) said effluent stream is condensed and separated to provide a vaporous phase and a liquid phase, (5) at least a first portion of said vaporous phase is recycled at increased pressure, via compressive means, to said reaction zone, and (6) a second portion of said vaporous phase is withdrawn from said conversion process via pressure control, which method comprises the steps of:

a. regulating the quantity of fuel supplied to said preheating means by adjusting a first flow-varying means in said fuel-supplying means;
b. regulating the quantity of the second portion of said vaporous phase withdrawn from said conversion process by adjusting a second flow-varying means;
c. regulating the quantity of compressed vaporous phase flowing from the discharge of said compressive means to the suction thereof by adjusting a third flow-varying means;
d. introducing a sample of said hydrocarbonaceous charge stock into a first hydrocarbon analyzer and developing therein a first output signal representative of a composition characteristic of said sample;
e. introducing a sample of said separated liquid phase into a second hydrocarbon analyzer and developing therein a second output signal representative of the octane of said sample;
f. introducing a sample of said recycled vaporous phase into a third analyzer and developing therein a third output signal representative of the hydrogen concentration of said sample;
g. monitoring the pressure of said separated vaporous phase and developing a fourth output signal representative of said pressure;
h. transmitting said first, second, third and fourth output signals to comparator means which compares the rate of change thereof, and the actual values of the composition characteristics the octane, the pressure and the hydrogen concentration, and generating therein fifth, sixth, seventh and eighth output signals; and,
i. transmitting at least one of said fifth, sixth, seventh and eighth output signals to at least one of said first, second and third flow-varying means, whereby the flow of said fuel, said withdrawn excess vaporous phase and/or the flow of compressed vaporous phase from the discharge of said compressive means to the suction thereof is adjusted in response to said composition characteristics, hydrogen concentration, octane and separated vaporous phase pressure, thereby regulating the hydrogen/hydrocarbon mole ratio in the feed stream to said reaction zone.

* * * * *